United States Patent [19]

Morris et al.

[11] 4,142,506

[45] Mar. 6, 1979

[54] HEATING APPLIANCES

[76] Inventors: William H. D. Morris, 64 Biscayne, Malahide, County Dublin; William J. R. Couchman, 33 Foxrock Ave., Dublin 18, both of Ireland

[21] Appl. No.: 825,428

[22] Filed: Aug. 17, 1977

[30] Foreign Application Priority Data

Aug. 18, 1976 [IE] Ireland ..... 1830/76

[51] Int. Cl.[2] ..... F24C 13/00

[52] U.S. Cl. ..... 126/5; 126/31; 126/34

[58] Field of Search ..... 126/5, 31, 34, 35

[56] References Cited

U.S. PATENT DOCUMENTS

| | | | |
|---|---|---|---|
| 422,426 | 3/1890 | Lofts | 126/31 |
| 1,266,534 | 5/1918 | Howell | 126/5 |
| 2,372,086 | 3/1945 | Kahn | 126/5 |
| 2,743,718 | 5/1956 | Kindig | 126/5 |

*Primary Examiner*—Edward G. Favors
*Attorney, Agent, or Firm*—McGlew and Tuttle

[57] ABSTRACT

The present invention provides a heating appliance which comprises a combustion chamber, a boiler adjacent the combustion chamber, and a flue system for conveying combustion gases from the combustion chamber. The flue system has two different routes for conveying combustion gases and a damper which may be selectively positioned to cause the gases to pass predominantly along either one or the other route. This arrangement permits the heat output to the boiler and an associated cooker unit to be varied while a constant firing rate is maintained in the combustion chamber. The applicance is preferably operated on solid fuel.

5 Claims, 4 Drawing Figures

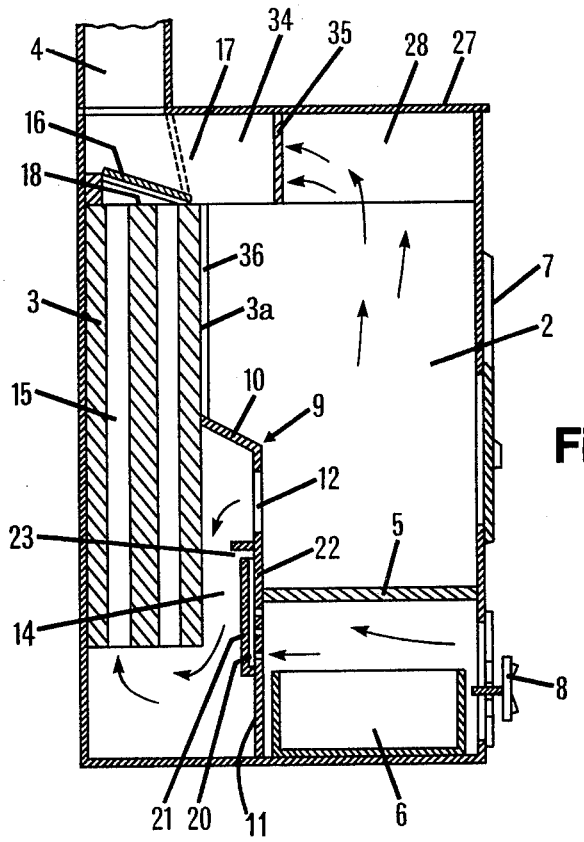
Fig. 2
Fig. 3
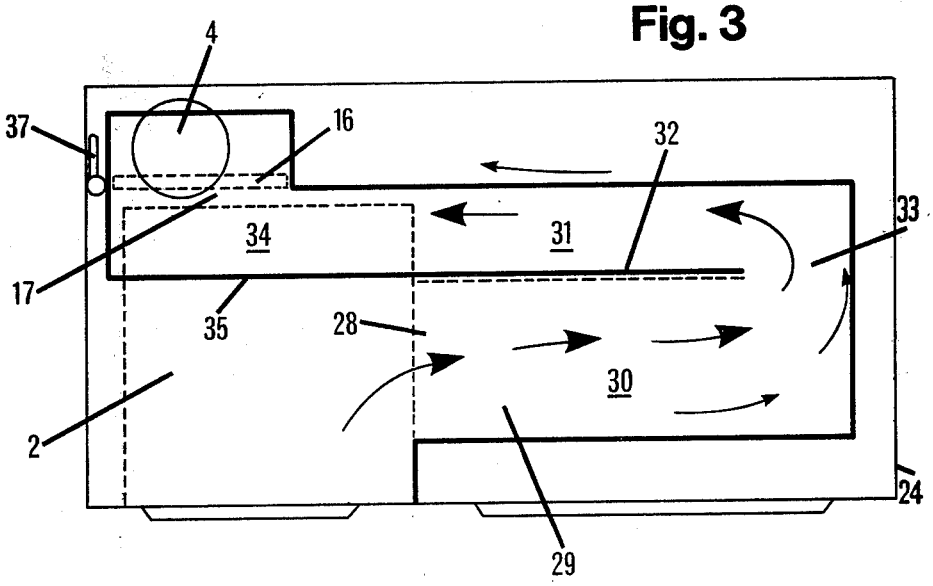

HEATING APPLIANCES

This invention relates to heating appliances and in particular to heating appliances that are fitted with boilers.

One of the problems associated with the design and operation of solid fuel heating appliances that are fitted with boilers is an overproduction of hot water whan a relatively high firing rate is required for other purposes such as local space heating or cooking. With oil and gas fired appliances such control is easier to achieve by adjusting the flame of the burner; however, these appliances are more expensive to run than solid fuel appliances.

It is an object of the present invention to provide a heating appliance wherein hot water output may be varied while a constant firing rate is maintained.

Accordingly, this invention provides a heating appliance comprising a combustion chamber, a boiler adjacent the combustion chamber, and a flue system for the conveyance of combustion gases from the combustion chamber, the flue system comprising two different routes for the conveyance of combustion gases and a damper means which may be selectively positioned to cause the gases to pass predominantly along either one or the other route, the two different routes being respectively a first route which by-passes the boiler and a second route which includes at least one boiler flue and a further flue defined by the space between a surface of the boiler facing the combustion chamber and a partition member positioned adjacent the said surface so as to maintain a part thereof spaced from the combustion chamber, the further flue being in communication both with the combustion chamber through an opening in the partition member and with the boiler flue.

Preferably the heating appliance is operated on solid fuel, the combustion chamber having conventional firebars, refractories and an ash receiver. Further, the heating appliance preferably incorporates means for introducing heated secondary air at a level above the fire bed to complete the combustion of volatile components remaining in the combustion gases.

It has been found that by using a heating appliance designed according to the present invention the hot water output may be varied on a 5 to 6:1 ratio while maintaining a constant firing rate.

Embodiments of the invention will now be described with reference to the accompanying drawings, in which:

FIG. 2 is a similar view of a second embodiment of the invention incorporating a cooker unit;

FIG. 3 is a schematic plan view of the appliance of FIG. 2; and

Figure 1:
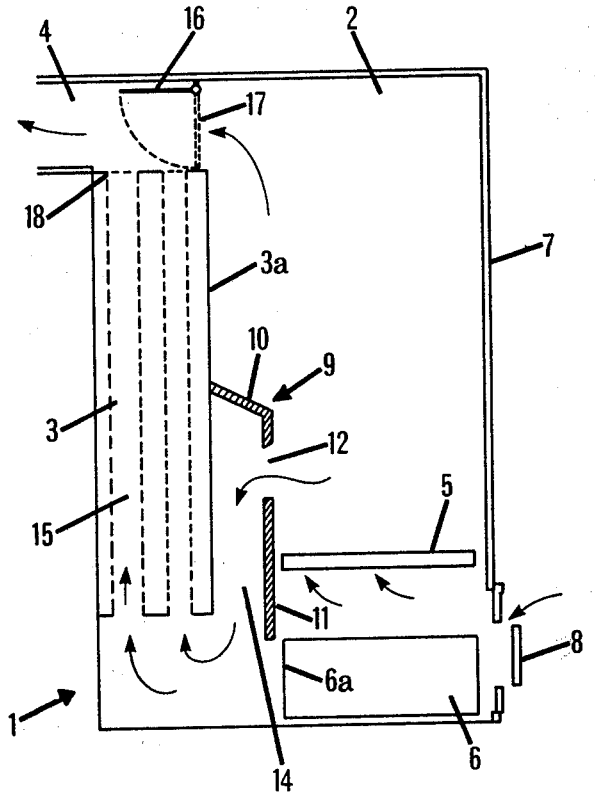
FIG. 1 is a schematic cross-sectional side view of a first embodiment of heating appliance according to the invention.

Referring to FIG. 1 of the drawings, a heating appliance 1 comprises a combustion chamber 2, a boiler 3 and a main flue 4 open to the atmosphere. The combustion chamber 2 has conventional firebars 5 and a conventional ash receiver 6 beneath the firebars 5. The front face 7 of the combustion chamber 2 has conventional openings (not shown) to the firebars 5 and the ash receiver 6, which are normally closed by doors, and air control means 8 for introducing supplies of primary and secondary air to the combustion chamber 2. The sides of the combustion chamber 2 incorporate refractories and the back of the combustion chamber is defined by a partition member, indicated generally at 9, and the upper part of the front surface 3*a* of the boiler 3, the partition member 9 serving to maintain the lower part of the surface 3*a* spaced from the combustion chamber 2. The partition member 9 comprises a hollow casting having an upper part 10, a lower part 11, and an opening 12 intermediate the two parts for the egress of combustion gases from the combustion chamber 2. The lower part 11 of the partition member 9 extends downwardly from the opening 12 to the top of the ash receiver 6, and the upper part 10 of the partition member 9 extends upwardly from the opening 12 and then slants towards the front surface 3*a* of the boiler 3.

The space 14 between the surface 3*a* of the boiler 3 and the combustion chamber 2 defines a flue for the conveyance of combustion gases to the boiler 3. The flue 14 is enclosed at its lower end by the rear face 6*a* of the ash receiver 6. Accordingly, the flue 14 is accessible for cleaning once the ash receiver 6 has been removed.

The boiler 3 is a conventional fire tube boiler unit having internal flues 15 which are open at both ends. A damper 16 is pivotally mounted at an opening 17 to the main flue 4. Alternatively, the damper 16 may be mounted at the top 18 of the boiler unit 3, as in the second embodiment to be described later. This damper 16 may be controlled by hand or by a thermostat or by both methods.

The combustion chamber 2 may, in addition, have flue connections to a cooker unit and/or a space heating system, in which case, an additional damper or dampers may be associated with the damper 16.

In use, with the damper 16 closing the opening 17 to the main flue 4, combustion gases are forced to enter the opening 12 of the partition member 9 and are thereby conducted by way of the flue 14 to the internal flues 15 of the boiler 3. The combustion gases eventually exhaust into the main flue 4 by way of the top 18 of the boiler 3. Thus the heated area of the boiler 3, and hence the boiler output, is a maximum under these conditions. Opening the damper 16, i.e. pivotting the damper away from the opening 17 to the main flue 4, results in hot gases leaving the combustion chamber 2 preferentially by way of the opening 17 to the main flue 4, this being by far the most direct route. With the damper 16 in this position, substantially the only part of the boiler 3 to receive heat is the area in contact with the combustion chamber 2, namely the portion of the front surface 3*a* thereof above the partition member 9. One effect of the positioning of the partition member 9 as shown is that the fire bed is not cooled at any point by contact with a water cooled surface, a feature of the appliance which favours overall combustion conditions.

When the combustion chamber 2 is directly open to the main flue 4 and the combustion gases are not required for space heating, for example, the combustion chamber may be used as an open fire, with the doors to the fire bed being left open.

Figure 4:
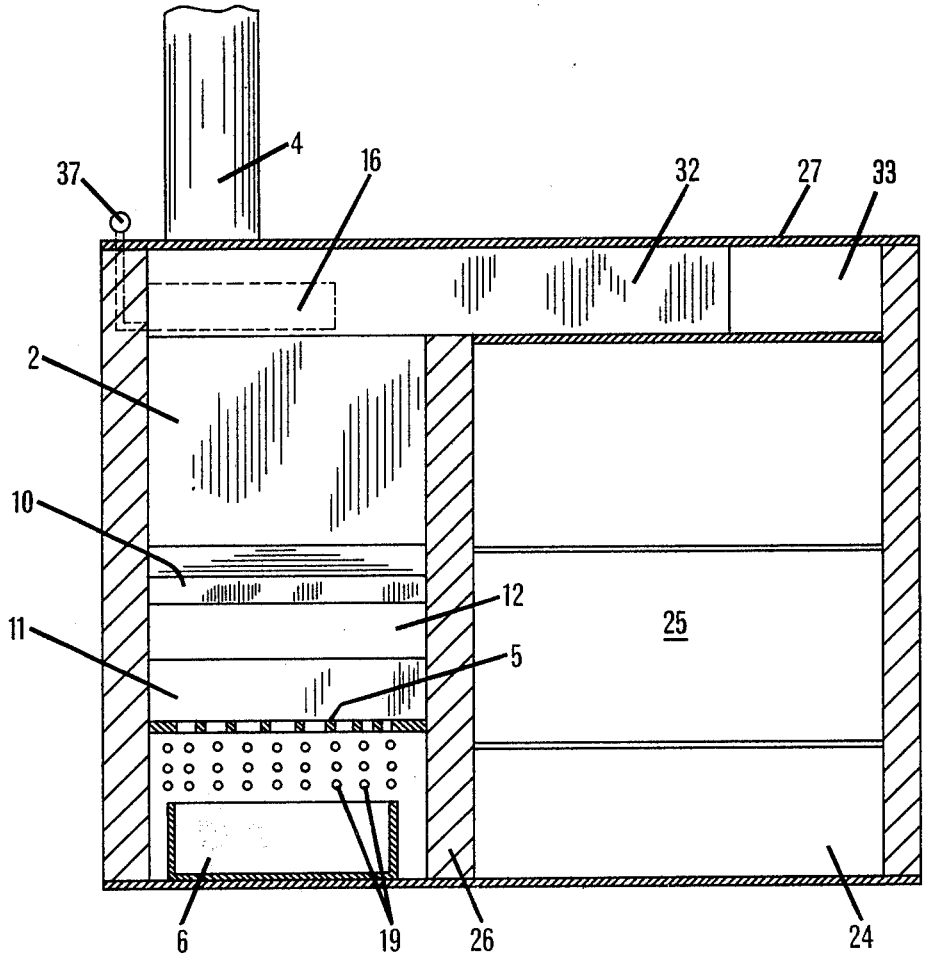
FIG. 4 is a front sectional view of the appliance of FIG. 2.

Preferably a channel exists between the refractories in the sides of the combustion chamber 2 and the side walls of the partition member 9 to define a path for the introduction of heated secondary air from the ashpit into the combustion chamber 2 at a level above the fire bed so as to achieve complete combustion of volatile components. Alternatively, the partition member 9 may incorporate a channel in the lower part 11 thereof which introduces heated secondary air from the ashpit to a region adjacent the opening 12 of the partition member 9. Such a channel is incorporated in the embodiment of FIGS. 2 to 4 which shows a heating appliance in combination with a cooker unit. In FIGS. 2 to 4 the same reference numerals have been used as in FIG. 1 in respect of equivalent parts of the appliance.

Referring now to FIGS. 2 to 4, beneath the firebars 5 the lower part 11 of the member 9 has a plurality of perforations 19 which admit heated air from the ashpit to a channel 20 (in which the air is further heated) formed by spaced-apart walls 21 and 22 of the member 19. The channel 20 is in communication with the upper part of the flue 14 by way of air opening 23 adjacent the opening 12. This arrangement provides a supply of heated secondary air from beneath the firebed to the region of the opening 12, whereupon on passing through the opening 23 the heated air causes ignition of volatile components remaining in the combustion gases leaving the combustion chamber 2. This ensures substantially smokeless combustion of the solid fuel.

The heating appliance of FIGS. 2 to 4 further comprises a cooker unit 24 having an oven portion 25 which is adapted to be heated by heat transfer through a wall 26 between the oven portion 25 and the combustion chamber 2.

The top of the cooker unit 24 comprises a hotplate 27. In this embodiment, when the damper is opened (by a handle 37) the combustion gases from the chamber 2 do not pass directly through the opening 17 to the main flue 4 as in the first embodiment, but are diverted beneath the hot plate (along the path shown by arrows in FIG. 3) by a system of partitions and baffles. More particularly, when the damper 16 is removed from the opening 17, i.e. moved from the broken line position to the solid line position of FIG. 2, combustion gases pass through an opening 28 and enter a region 29 beneath the hot plate 27. The region 29 is divided into front and rear sections 30 and 31 respectively by a baffle 32, the two sections 30 and 31 being in communication via an aperture 33. The hot gases leave the rear section 31 and enter a chamber 34 which communicates with the flue 4 via the opening 17.

The front face 35 of the chamber 34 may be provided with a closable aperture (not shown) which is opened when fuel in the combustion chamber 2 is initially lit and which permits direct exit of smoke from the combustion chamber 2 into the flue 4. A layer of firebrick 36 is positioned at the rear of the combustion chamber 2 above the member 9 and below the chamber 34.

It is to be noted that in this second embodiment the opening of the damper 16 not only permits the exit of combustion gases through the opening 17 but also closes, and thus positively prevents the exit of gases from, the top 18 of the boiler 3. This is described since otherwise the longer path for the gases under the hotplate 27 would reduce the proportion of the gases tending to exit by this route when the damper is opened compared to the first embodiment where the exit route via the opening 17 is more direct. The closure of the top 18 of the boiler thus forces the combustion gases under the hotplate, just as the closure of the opening 17 forces the gases through the boiler.

We claim:

1. A solid fuel heating appliance comprising a combustion chamber containing a firebed for supporting the solid fuel and an ashpit below the firebed, a boiler adjacent the combustion chamber, and a flue system for the conveyance of combustion gases from the combustion chamber, said flue system comprising two different routes for the conveyance of combustion gases and damper means which may be selectively positioned to cause the gases to pass predominantly along a selected one of said two different routes, said two different routes comprising a first route which by-passes said boiler and a second route which includes at least one boiler flue and a further flue defined by the space between a surface of said boiler facing the combustion chamber and a partition member positioned adjacent the said surface so as to maintain a part thereof spaced from the combustion chamber, said further flue being in communication both with said combustion chamber, through an opening in the partition member, and with said boiler flue, and means for supplying heated secondary air at a level above said firebed so as to effect combustion of volatile components remaining in the combustion gases comprising a channel in said partition member, which extends from below the firebed to adjacent the opening in said partition member.

2. A heating appliance according to claim 1, further comprising a cooker unit, having a hotplate, the said first route having a portion below the hotplate whereby the latter is heated by combustion gases passing along the first route.

3. A heating appliance according to claim 2, in which the cooker unit further comprises an oven portion below the hotplate, the oven portion being adapted to be heated by heat transfer through a wall between the oven portion and the combustion chamber.

4. A heating appliance according to claim 1, further comprising a cooker unit, having a hotplate, the said first route having a portion below the hotplate whereby the latter is heated by combustion gases passing along the first route.

5. A heating appliance according to claim 4, in which the cooker unit further comprises an oven portion below the hotplate, the oven portion being adapted to be heated by heat transfer through a wall between the oven portion and the combustion chamber.

* * * * *